US006799681B1

(12) United States Patent
Warren

(10) Patent No.: US 6,799,681 B1
(45) Date of Patent: Oct. 5, 2004

(54) PORTABLE HYDRAULIC CLASSIFIER

(76) Inventor: Albert J. Warren, 2400 Emery St., Longmont, CO (US) 80501

( * ) Notice: Subject to any disclaimer, the term of this patent is extended or adjusted under 35 U.S.C. 154(b) by 53 days.

(21) Appl. No.: 10/067,717

(22) Filed: Feb. 5, 2002

(51) Int. Cl.[7] ..... B03B 7/00; B07C 5/00

(52) U.S. Cl. ..... 209/44; 209/44.2; 209/268; 209/420

(58) Field of Search ..... 209/44, 44.2, 420, 209/268, 12.1, 236, 250, 422, 458, 460, 500, 501, 506, 508

(56) References Cited

U.S. PATENT DOCUMENTS

| | | | | | |
|---|---|---|---|---|---|
| 46,641 | A | * | 3/1865 | Clark | 209/440 |
| 178,289 | A | * | 6/1876 | Ginn | 209/44 |
| 219,926 | A | * | 9/1879 | Eddy | 209/458 |
| 247,077 | A | * | 9/1881 | Lodwick | 209/44 |
| 563,046 | A | * | 6/1896 | Mait | 209/440 |
| 1,915,602 | A | * | 6/1933 | Goody | 209/273 |
| 4,319,985 | A | | 3/1982 | Hibbard | |
| 4,375,491 | A | | 3/1983 | Honig | |
| 4,523,989 | A | * | 6/1985 | Graefe | 209/44 |
| 4,592,833 | A | | 6/1986 | Perdue | |
| 4,642,180 | A | * | 2/1987 | Kaufman | 209/44 |
| 5,287,975 | A | * | 2/1994 | Chumley et al. | 209/3 |
| 5,421,461 | A | * | 6/1995 | Ruzic | 209/44 |
| D377,182 | S | * | 1/1997 | Simpson | D15/147 |
| 5,617,955 | A | * | 4/1997 | Tanner | 209/458 |
| 5,785,182 | A | | 7/1998 | Ashcraft | |
| 6,584,991 | B1 | * | 7/2003 | Ries | 134/131 |

* cited by examiner

*Primary Examiner*—Donald P. Walsh
*Assistant Examiner*—Joseph Rodriguez

(57) ABSTRACT

A portable hydraulic classifier (10) for mining gold from stream beds wherein the hydraulic classifier (10) includes a lower sluice unit (11) hingedly connected to an upper sluice unit (12) equipped with a water supply unit (14) and a support unit (13) adapted to allow angular adjustment of the upper sluice unit (12) relative to the lower sluice unit (11) wherein the support unit (13) further includes a pair of support leg assemblies (40) (40') wherein at least one of the support leg assemblies (40) is provided with a cross-piece element (43) that serves as a handle for transporting the hydraulic classifier (10).

13 Claims, 2 Drawing Sheets

PORTABLE HYDRAULIC CLASSIFIER

CROSS REFERENCE TO RELATED APPLICATIONS

This invention was the subject matter of Disclosure Document Program Registration No. 494,268 filed on May 25, 2001.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of hydraulic classifiers in general and in particular to a lightweight, portable, collapsible hydraulic classifier specifically designed for recreational gold miners and small mine operators.

2. Description of Related Art

As can be seen by reference to the following U.S. Pat. Nos. 4,375,491; 4,592,833; 5,785,182; and, 4,319,985, the prior art is replete with myriad and diverse sluice boxes and gold concentrators.

While all of the aforementioned prior art constructions are more than adequate for the basic purpose and function for which they have been specifically designed, they are uniformly deficient with respect to their failure to provide a simple, efficient, and practical adjustable height, lightweight, portable, collapsible hydraulic classifier that may quickly and easily be transported, erected, collapsed and removed from a number of promising locations on a placer stream that could conceivably contain gold particles, nuggets, flakes, etc.

As most recreational miners are all too well aware, one of the greatest challenges in pursuing their hobby is the difficulty encountered in transporting an efficient hydraulic classifier to and from a promising location on a stream bed.

As a consequence of the foregoing situation, there has existed a longstanding need among recreational miners for a new and improved portable hydraulic classifier that will overcome all of the shortcomings of the prior art classifier arrangements; and the provision of such a construction is a stated objective of the present invention.

BRIEF SUMMARY OF THE INVENTION

Briefly stated, the portable hydraulic classifier that forms the basis of the present invention comprises in general a lower sluice unit, an upper sluice unit, an adjustable, collapsible support unit and a hydraulic supply unit wherein the upper sluice unit is hingedly connected to the lower sluice unit, the support unit is capable of varying the angular inclination of the upper sluice unit relative to the lower sluice unit and the hydraulic supply unit delivers flowing water to both the upper and lower sluice units.

As will be explained in greater detail further on in the specifictiton, the lower sluice unit includes a lower sluice framework member having a downwardly angled floor panel provided with a riffle array including a plurality of rearwardly angled riffle plates and a vertical collector plate having a forwardly extending lip wherein the riffle array extends between the raised sidewalls of the upper sluice framework member.

The upper sluice unit includes an upper sluice framework member having raised sidewalls connected to a downwardly angled floor panel equipped with an enlarged rectangular opening covered by a plurality of closely spaced classifier rods and disposed adjacent the hinged open front of the upper sluice framework member.

In addition, the support unit includes a pair of different height support leg assemblies pivotally attached to the lower sluice framework member and most importantly a pair of adjustable support arms operatively associated with the rear portions of the upper and lower sluice framework members and adapted to vary the angular orientation of the upper sluice framework member relative to the lower sluice framework member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
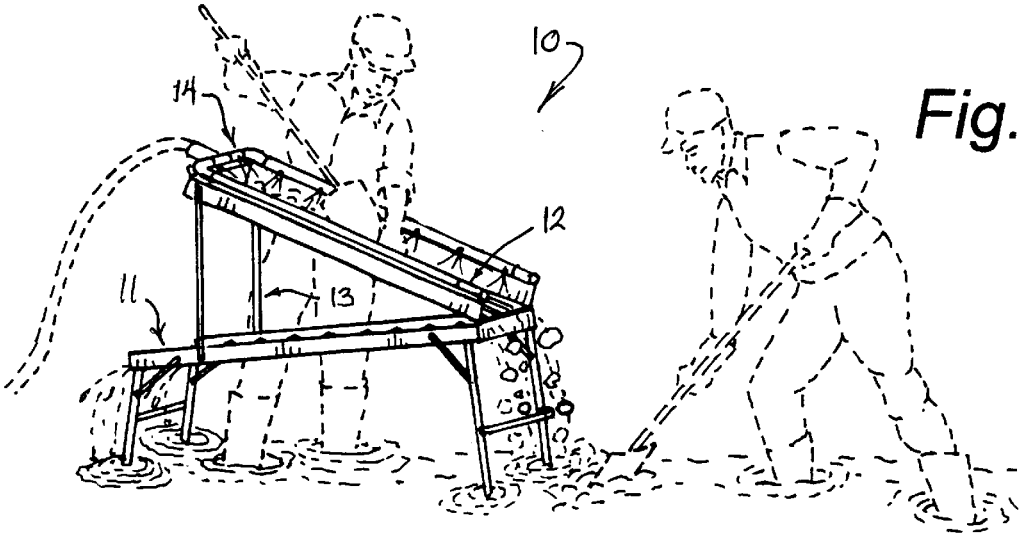
FIG. 1 is a perspective view of the portable hydraulic classifier that forms the basis of the present invention in use.

As can be seen by reference to the drawings, and in particularly to FIG. 1, the portable hydraulic classifier that forms the basis of the present invention is designated generally by the reference number 10. The hydraulic classifier 10 comprises in general a lower sluice unit 11, an upper sluice unit 12, an adjustable support unit 13, and a hydraulic supply unit 14. These units will now be described in seriatim fashion.

Figure 2:
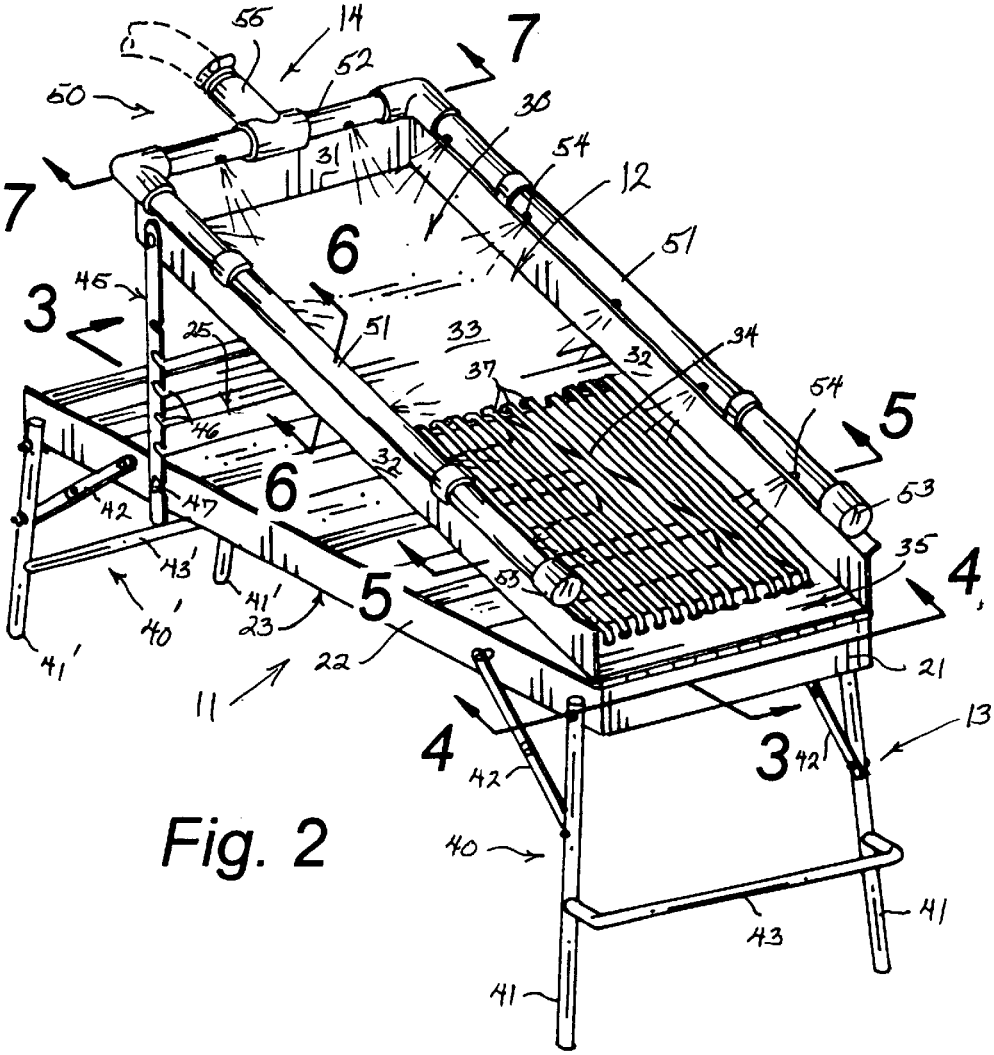
FIG. 2 is an isolated perspective view of the hydraulic classifier.
Figure 3:
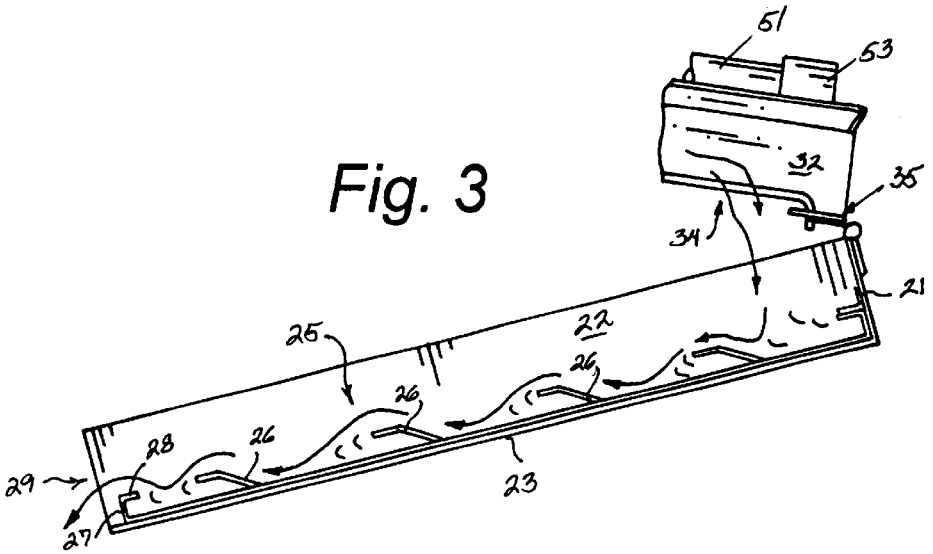
FIG. 3 is a cross-sectional view taken through line 3—3 of FIG. 2.

As shown in FIGS. 2 and 3, the lower sluice unit 11 is disposed at a downwardly inclined angle by a portion of the support unit 13 and comprises a generally rectangular lower sluice framework member 20 and a floor panel 23 provided with a riffle array designated generally as 25.

As can best be appreciated by reference to FIG. 3, the riffle array 25 includes a plurality of rearwardly angled riffle plates 26 disposed at spaced locations on the floor panel 23 and extending laterally between the opposed sidewalls 22 of the lower sluice framework member 20.

In addition, a collector plate 27 having a forwardly facing upper lip 28 is disposed adjacent the open rear end 29 of the lower sluice framework member 20 for reasons that will be explained further on in the specification.

Turning now to FIGS. 2, and 4 through 6, it can be seen that the upper sluice unit 12 is also disposed at a downwardly inclined adjustable angle by another portion of the support unit 13, and comprises a generally rectangular upper sluice framework member 30 having a raised rear wall 31, a pair of raised sidewalls 32, and a floor panel 33 having an enlarged generally rectangular opening 34 disposed toward its open front end 35 which is hingedly connected as at 36 to the raised front wall 21 of the lower sluice framework member 20.

Figure 4:
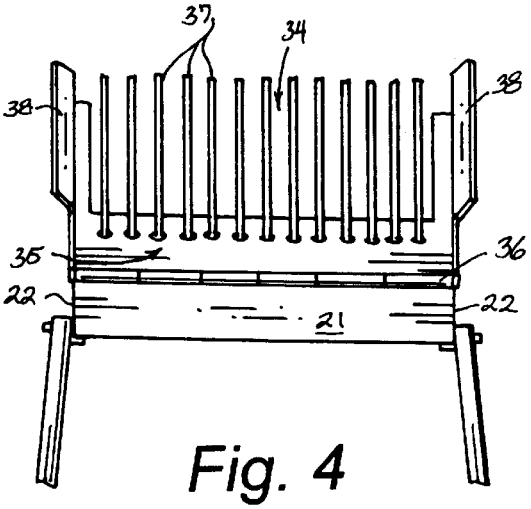
FIG. 4 is a cross-sectional view taken through line 4—4 of FIG. 2.
Figure 5:
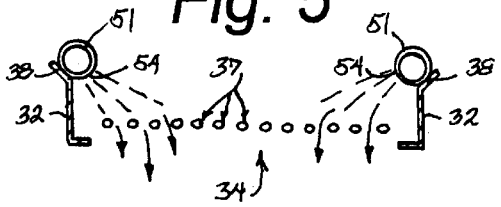
FIG. 5 is a cross-sectional view taken through line 5—5 of FIG. 2.

In addition, as shown in FIGS. 4 and 5, the enlarged opening 34 in the floor panel 33 of the upper sluice framework member 30 extends almost completely across the front portion of the floor panel 33 and is further provided with a plurality of closely spaced classifier rods 37 aligned parallel to the longitudinal axis of the upper sluice framework member 30; wherein, the spacing between the classifier rods 37 is chosen to only allow small particles to pass between the rods 37 and be deposited by gravity on the front portion of the lower sluice framework member 20.

Figure 6:
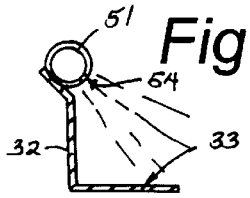
FIG. 6 is a cross-sectional view taken through line 6—6 of FIG. 2.
Figure 7:
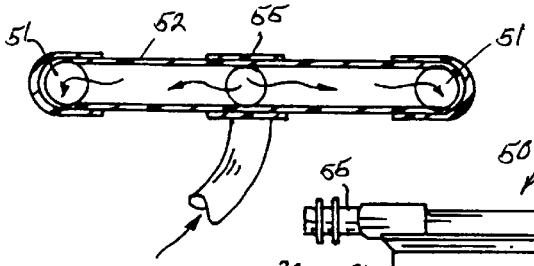
FIG. 7 is a cross-sectional view taken through line 7—7 of FIG. 2.

As can be seen by reference to FIGS. 4 through 6, the upper ends of the raised walls 31/32 are provided with an outwardly projecting lip 38 whose purpose and function will be described presently.

Returning once more to FIG. 2, it can be seen that the support unit 13 comprises a pair of collapsible support leg assemblies designated generally as 40 which are disposed on the front and rear portions of the lower sluice framework member 20. Each of the support leg assemblies 40 40' includes a pair of support legs 41 pivotally connected on their upper ends to the sidewalls 22 of the lower sluice framework member 20 wherein each support leg 41 is provided with a collapsible brace element 42 extending from the upper portion of the support leg 41 to the sidewalls 22 of the lower sluicing member 20 in a well recognized manner.

In addition, the support legs 41 41 on the front support leg assembly 40 are substantially longer than the support legs 41'41' on the rear support leg assembly 40' so as to maintain the front portion of the lower sluice framework member 20 at a greater height than the rear portion.

Figure 8:
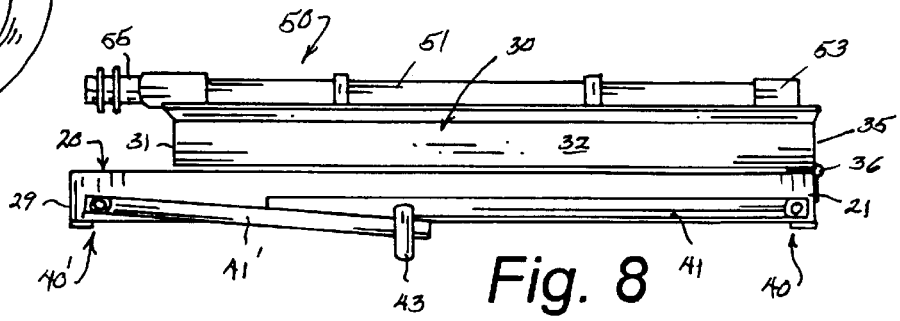
FIG. 8 is a side elevation view of the hydraulic classifier in its collapsed state

Furthermore, each pair of support leg members 41 41 and 41'41' is provided with a cross-piece connector 43 43' wherein the front cross-piece connector 43 has a generally shallow U-shaped configuration so that this structural component can also serve as a transport handle when the hydraulic classifier is collapsed into the transport mode depicted in FIG. 8.

Still referring to FIG. 2, it can be seen that the support unit further comprises a pair of adjustable height support arms 45 having their upper ends pivotally attached to the rear portion of the sidewalls 32 on the upper sluice framework member 30 wherein one side of the support arms 45 is provided with a plurality of vertically spaced notches 46 which are dimensioned to selectively engage a pair of outwardly projecting pegs 47 provided on the rear portion of the side walls 22 of the lower sluice framework member 20 so that the angular disposition of the upper sluice framework member 30 relative to the lower sluice framework member 20 may be varied to accommodate different working conditions.

As shown in FIGS. 2, and 5 through 8, the hydraulic supply unit 14 comprises a generally U-shaped piping array designated generally as 50 wherein the legs 51 of the piping array 50 are provided with end cap closures 53 that rest on the angled lip 38 on the raised sidewalls 32 of the upper sluice framework member 30 and the base 52 of the piping array 50 is supported on the angled lip 38 on the raised rear wall 31.

Furthermore, the inner faces of the legs 51 and base 52 of the piping array 50 are provided with a plurality of downwardly angled spaced apertures 54 to deliver a steady flow of water along the entire length of the downwardly angled floor panel 33 of the upper sluice framework member 30; and the base 52 of the piping array 50 is further provided with a T-pipe connector 55 that is adapted to receive a pumped supply of water extracted from the stream.

By now it should be appreciated that the piping array 50 washes the extracted stream bed deposits along the floor panel 33 of the upper sluice box framework 30 while the classifying rods 37 cause larger rocks, stones and pebbles to exit out the open front end thereof while the smaller particles and water flow are deposited on the front portion of the floor panel 23 of the lower sluice framework member 20. The water flow will then cause the lighter weight particles to be swept along the riffle array 25 with the heavier gold particles settling out at the base of the riffle plates 27 and ultimately accumulated at the collector plate 28 in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A portable hydraulic classifier for mining gold particles, nuggets and flakes from a streambed wherein the hydraulic classifier comprises a lower sluice unit including a lower sluice framework member having a downwardly angled floor panel provided with a riffle array an upper sluice unit including an upper sluice framework member having a downwardly angled floor panel whose lowest end is hingedly connected to the highest end of the lower sluice framework member; and, means for angularly adjusting the upper sluice framework member relative to the lower sluice framework member; and, a support unit including in part a pair of front, and rear support leg assemblies pivotally associated with the upper and lower ends of the lower sluice framework member wherein, the front support leg assembly has a greater vertical height than the ear support leg assembly wherein, each of the support leg assemblies comprises a pair of support legs having upper ends pivotally connected to the lower sluice framework member and a cross-piece connector; and, wherein, the cross-piece connector on the front support leg assembly has a generally shallow U-shaped configuration.

2. The hydraulic classifier as in claim 1; wherein, the cross-piece connector on the front support leg assembly is contoured to serve as a handle element during the transport of the hydraulic classifier.

3. The hydraulic classifier as in claim 1 wherein the pair of support arms is pivotally associated with one of the upper and lower sluice framework members and has a plurality of vertically spaced notches formed on one side wherein the other of the upper and lower framework members is provided with a pair of outwardly projecting post elements adapted to be received in a selected one of the plurality of notches formed in each of the support arms.

4. The hydraulic classifier as in claim 1; wherein, both the upper and lower sluice framework members are provided with raised side walls, the upper sluice framework member is also provided with a raised rear wall and an open front and the lower sluice framework member is also provided with a raised front wall and an open rear.

5. The hydraulic classifier as in claim 4; wherein, the rear wall and side walls of the upper sluice framework member have upper portions provided with an outwardly extending lip.

6. The hydraulic classifier as in claim 5 further comprising:

a water supply unit including a generally U-shaped piping array supported on the legs of the rear wall and sidewalls of the upper sluice framework member wherein the piping array is further provided with a plurality of inwardly directed apertures.

7. The hydraulic classifier as in claim 4 further comprising:

a water supply unit including a generally U-shaped piping array operatively associated with at least the side walls of the upper sluice framework member wherein the piping array is further provided with a plurality of inwardly directed apertures.

8. The hydraulic classifier as in claim 1; wherein, the riffle array includes a plurality of rearwardly angled riffle plates disposed at spaced locations along the floor platform of the lower sluice framework member.

9. The hydraulic classifier as in claim 8; wherein, the riffle array further includes a collector plate disposed adjacent the rear end of the lower sluice framework member.

10. The hydraulic classifier as in claim 8; wherein, the floor panel of the upper sluice framework member is provided with an enlarged opening disposed adjacent the front end of said floor panel and a plurality of closely spaced classifier rods extending over said enlarged opening end aligned with the longitudinal axis of the upper sluice framework member.

11. A portable hydraulic classifier for mining gold particles, nuggets and flakes from a streambed wherein the hydraulic classifier comprises a lower sluice unit including a lower sluice framework member having a downwardly angled floor panel provided with a riffle array an upper sluice unit including an upper sluice framework member having a downwardly angled floor panel whose lowest end is hingedly connected to the highest end of the lower sluice framework member; wherein, both the upper and lower sluice framework members are provided with raised side walls, the upper sluice framework member is provided with a raised rear wall and an open front and the lower sluice framework member is provided with a raised front wall and an open rear; and, a water supply unit including a generally U-shaped piping array supported on the legs of the rear wall and sidewalls of the upper sluice framework member wherein the piping array is further provided with a plurality of inwardly directed apertures that are disposed on both legs and the base of the U-shaped piping array.

12. The hydraulic classifier as in claim 11; wherein, the riffle array includes a plurality of rearwardly angled riffle plates disposed at spaced locations along the floor platform of the lower sluice framework member.

13. The hydraulic classifier as in claim 11; wherein, the floor panel of the upper sluice framework member is provided with an enlarged opening disposed adjacent the front end of said floor panel and a plurality of closely spaced classifier rods extending over said enlarged opening and aligned with the longitudinal axis of the upper sluice framework member.

* * * * *